US006095634A

United States Patent [19]

Kishi

[11] Patent Number: 6,095,634

[45] **Date of Patent: *Aug. 1, 2000**

[54] MANUAL PRINTING DEVICE

[75] Inventor: Motoshi Kishi, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,015

[22] Filed: Mar. 21, 1997

[30] Foreign Application Priority Data

Mar. 22, 1996 [JP] Japan ..... 8-093227

[51] Int. Cl.[7] ..... B41J 2/165; B41J 3/36

[52] U.S. Cl. ..... 347/35; 347/109

[58] Field of Search ..... 347/109, 35, 87; 400/88

[56] References Cited

U.S. PATENT DOCUMENTS

| | | | |
|---|---|---|---|
| 2,173,741 | 9/1939 | Wise et al. | 347/109 |
| 4,412,232 | 10/1983 | Weber et al. | 347/109 |
| 4,758,849 | 7/1988 | Piatt et al. | 347/109 |
| 4,785,314 | 11/1988 | Teresawa et al. | 347/87 |
| 4,901,164 | 2/1990 | Kurosawa | 358/473 |
| 5,240,334 | 8/1993 | Epstein et al. | 400/88 |
| 5,501,535 | 3/1996 | Hastings et al. | 400/88 |
| 5,593,236 | 1/1997 | Bobry | 400/88 |
| 5,634,730 | 6/1997 | Bobry | 400/88 |

FOREIGN PATENT DOCUMENTS

| | | | |
|---|---|---|---|
| 2592-337 | 7/1987 | France | 347/109 |
| 55-142665 | 11/1980 | Japan | 347/85 |
| 56-118868 | 9/1981 | Japan | 347/35 |

*Primary Examiner*—John Barlow
*Assistant Examiner*—M. Brooke
*Attorney, Agent, or Firm*—McGinn & Gibb, P.C.

[57] ABSTRACT

A manual printing device for printing on a recording medium when scanned over the recording medium in a print direction, the manual printing device comprising: an ink tank filled with ink; a recording unit in formed with an ink ejection aperture in fluid connection with the ink tank, the recording unit ejecting ink supplied from the ink tank through the ink ejection aperture onto the recording medium; and a recovery unit for applying pressure to the ink in the ink tank to eject ink from the ink ejection aperture.

20 Claims, 5 Drawing Sheets

MANUAL PRINTING DEVICE

BACKGROUND OF THE INVENTION

1. Field of the Invention

The present invention relates to a manually operated printing device which a user manually scans across a recording medium, such as paper to print predetermined patterns on the recording medium.

2. Description of the Related Art

Nozzles of a recor4ding head can become clogged with dust or filled with air bubbles. These can result in defective printing. Conventional printing devices are provided with purge type recovery units for returning the recording head to good operating condition. The purge type recovery unit is connected with the nozzle plate of the recording head and used to suck ink, and consequently the dust and air bubbles, out of the nozzles of the head.

SUMMARY OF THE INVENTION

However, conventional suction-type recovery devices have a large size and a complicated configuration and so are difficult to incorporate into the body of a manual printing device. Therefore, a special recovery device independent from the body must be provided for manual printing devices. Also, suction force is not always reliably transmitted from the recovery unit to the recording head, so purge operations are often insufficient.

It is an objective of the present invention to overcome the above-described problems and to provide a manual printing device requiring no special independent recovery device for recovering printing quality of the recording head and wherein recovery operations can be sufficiently performed without use of a complicated configuration.

In order to achieve the above-described objectives, a manual printing device according to the present invention is for printing on a recording medium when scanned over the recording medium in a print direction, and the manual printing device includes: an ink tank filled with ink; a recording unit formed with an ink ejection aperture in fluid connection with the ink tank, the recording unit ejecting ink supplied from the ink tank through the ink ejection aperture onto the recording medium; and a recovery unit for applying pressure to the ink in the ink tank to eject ink from the ink ejection aperture.

With this configuration, purge operations are performed by ejecting ink from the nozzles. Therefore, the recording head can be returned to a good printing condition more effectively than when purged using suction force.

According to another aspect of the invention, the recovery unit includes: a piston mechanism having a piston for applying pressure to the ink in the ink tank when pressed against; and a pressing mechanism connected with the piston of the piston mechanism so that the pressing mechanism presses against the piston when moved in a pressing direction. With this configuration, by pushing the piston down using the pressing mechanism, pressure is applied to ink in the ink tank, whereupon a recovery operation is performed by ejecting ink from the nozzles of the head. Therefore, recovery operations can be performed with a simple mechanism and without wasting ink.

When the ink tank is connected to atmosphere by a through hole formed in the pressing mechanism, the pressure in the ink tank will be maintained equal to atmospheric pressure. Therefore, a negative pressure can be prevented from building up in the ink tank while ink consumed from the ink tank.

By arranging the pressing mechanism so that its top portion is exposed to the outside of the manual printing device, recovery operation can be performed by a user pressing down the top of the push-down mechanism with his or her finger. Therefore, there is no need to provide a drive source for driving the pressing mechanism so that the manual printing device can be made lighter and in a more compact size. Because an air hole is opened through the upper portion of the push-down mechanism, ejection purge can be effectively performed by pushing the push-down mechanism down while covering the opening with the user's finger.

According to a different aspect of the present invention, the recovery device is incorporated into the body of the manual printing device so that no special recovery device needs to be provided separately. The manual printing device can therefore be made in a more compact size.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
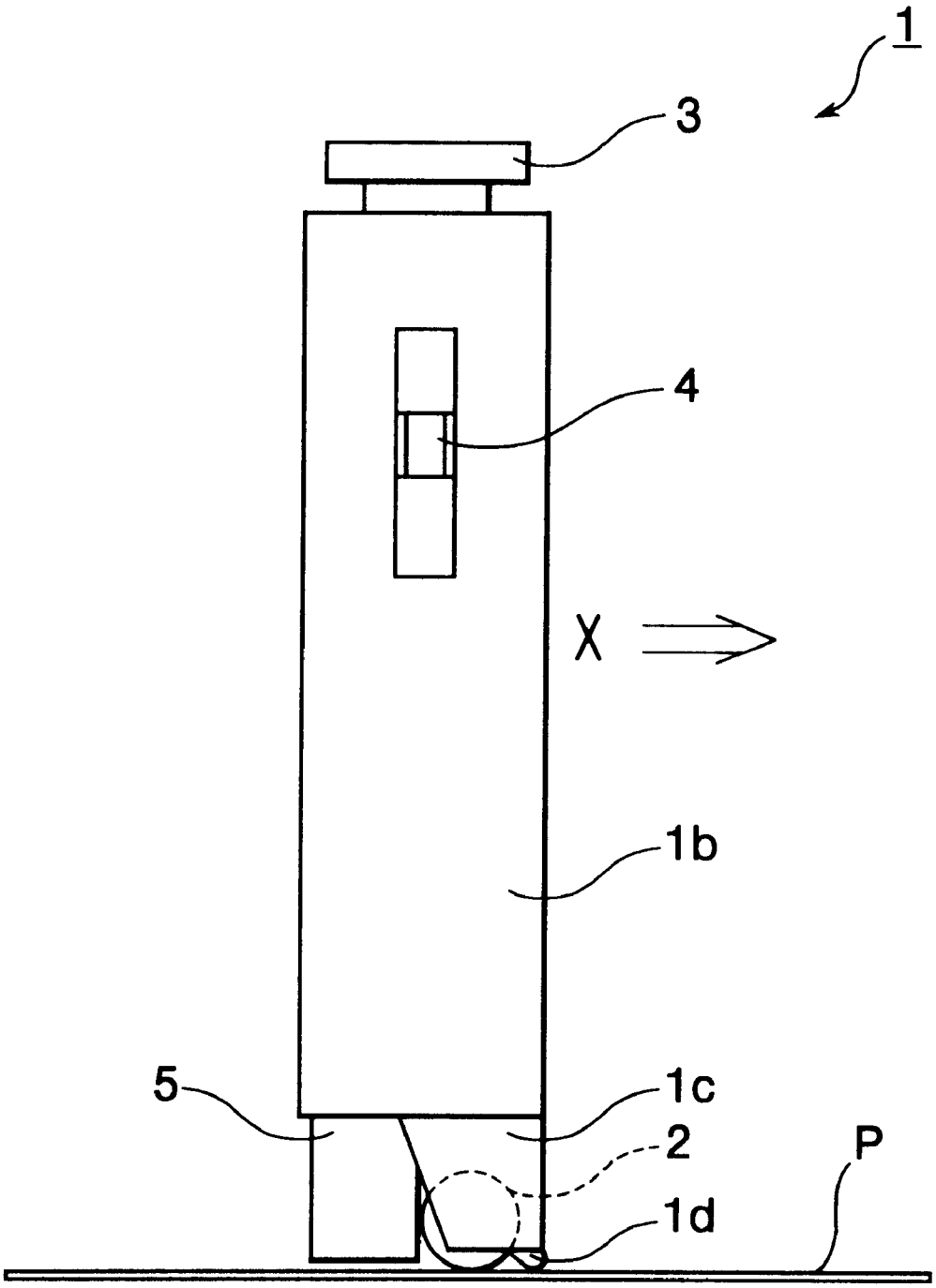
FIG. 1 is an external view showing a manual printing device according to an embodiment of the present invention.

A manual printing device according to a preferred embodiment of the present invention will be described while referring to the accompanying drawings wherein like parts and components are designated by the same reference numerals to avoid duplicating description.

FIG. 1 is an external view showing a manual printing device according to the present embodiment of the present invention. A body 1*b* of a manual printing device 1 is formed in a square shape so as to be easy for a user to hold by hand. A roller 2 is rotatably provided to the lower tip of the body 1*b*. A purge button 3 for applying pressure to ink in an ink tank 8 (see FIG. 2) is provided to the upper tip of the body 1*b*. A switch 4 for turning a power source on and off and for selecting a printing mode of the manual printing device 1 is provided to the body 1*b*. An interface portion 20 (see FIG. 5) for performing infrared transmission with an external device to transmit and receive a variety of data, such as print data, is also provided to the upper tip of the body 1*b*.

An ink jet recording head 5 serving as a recording unit is provided near the roller 2 of the body 1*b*. The roller 2 is supported by a frame 1*c* having a protrusion portion 1*d*. The protrusion portion 1*d* is formed from a material, such as a resin material, having good sliding characteristics.

In order to print the print data or other data inputted from an external device and the like onto a recording medium P, such as a print sheet, a user holds the body 1*b* by hand and scans the body 1*b* in a direction indicated by an arrow X in FIG. 1 across the surface of the recording medium P while maintaining the roller 2 and the protrusion portion 1*d* in contact with the upper surface of the recording medium P. During printing, the roller 2 and the protrusion portion 1*d* maintain the upright orientation of the body 1 and fix the distance from the surface of the recording medium P to the ink jet recording head 5. Printing of a predetermined image is performed by using, in a manner to be described later, rotation of the roller 2 to detect relative position (i.e., movement) between the ink jet recording head 5 and recording medium P.

Figure 2:
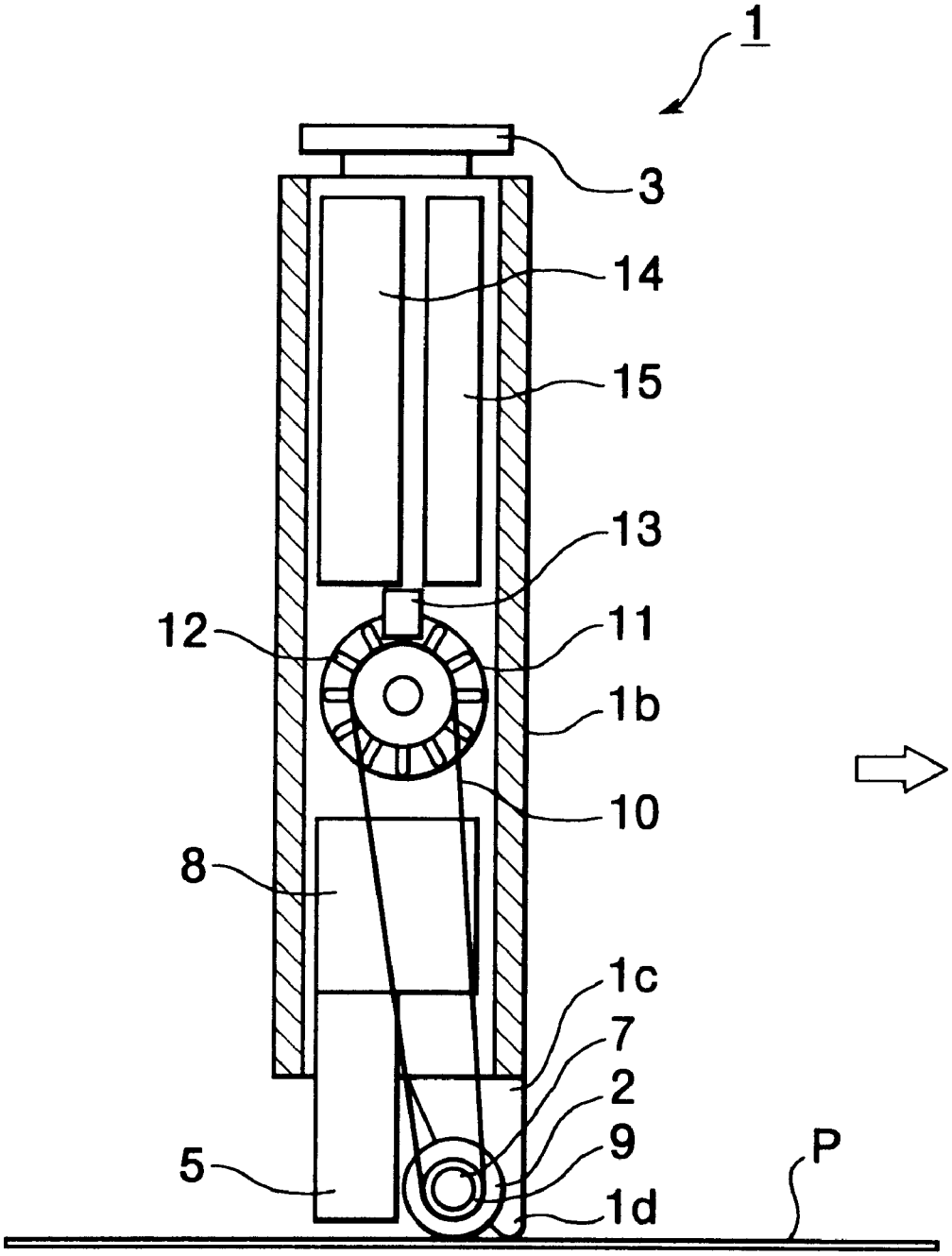
FIG. 2 is a cross-sectional view showing internal configuration of the manual printing device of FIG. 1.

FIG. 2 is a cross-sectional view showing internal configuration of the manual printing device 1. Next, an explanation will be provided for the internal configuration of the manual printing device 1 while referring to FIG. 2. The roller 2 is provided to the lower tip of the body 1*b* on a shaft 7 so as to be freely rotatable around the shaft 7. To prevent the roller 2 from smudging freshly printed images, the ink jet recording head 5 is disposed to the rear of the roller 2 in regards to the scanning direction X of the manual printing device 1. The ink tank 8 for supplying ink to the ink jet recording head 5 is disposed above the ink jet recording head 5.

A pulley 9 is fixed to the shaft 7 of the roller 2 so as to rotate around the shaft 7 in association with rotation of the roller 2. An encoder 11 having a rotation disk 12 is disposed near the center of the body 1*b*. A belt 10 is suspended between the pulley 9 and the rotation disk 12 so that rotational force generated by the pulley 9 in association with rotation of the roller 2 is transmitted to the rotation disk 12 of the encoder 11. Slits are provided around the periphery of the rotation disk 12 at a predetermined interval. A photointerrupter 13 of the encoder 11 is turned on and off by rotation of the rotation disk 12. The photointerrupter 13 converts the rotational speed of the roller 2, that is, relative position between the ink jet recording head 5 and the recording medium P, into an intermittent electric pulse signal. The signal is inputted to a control portion 14 to be described later. The photointerrupter 13 also detects the rotational direction of the roller 2.

The control portion 14 for controlling recording operations of the ink jet recording head 5, detection operation of the photointerrupter 13, and an interface portion provided for receiving print data is provided in the upper portion of the body 1*b*. A power source 15 for supplying power to electrical components of a control system (to be described later) is provided near the control portion 14. The power source 15 includes a small power supply portion, such as, a dry cell battery, and a device for stabilizing supply of the power.

Figure 3:
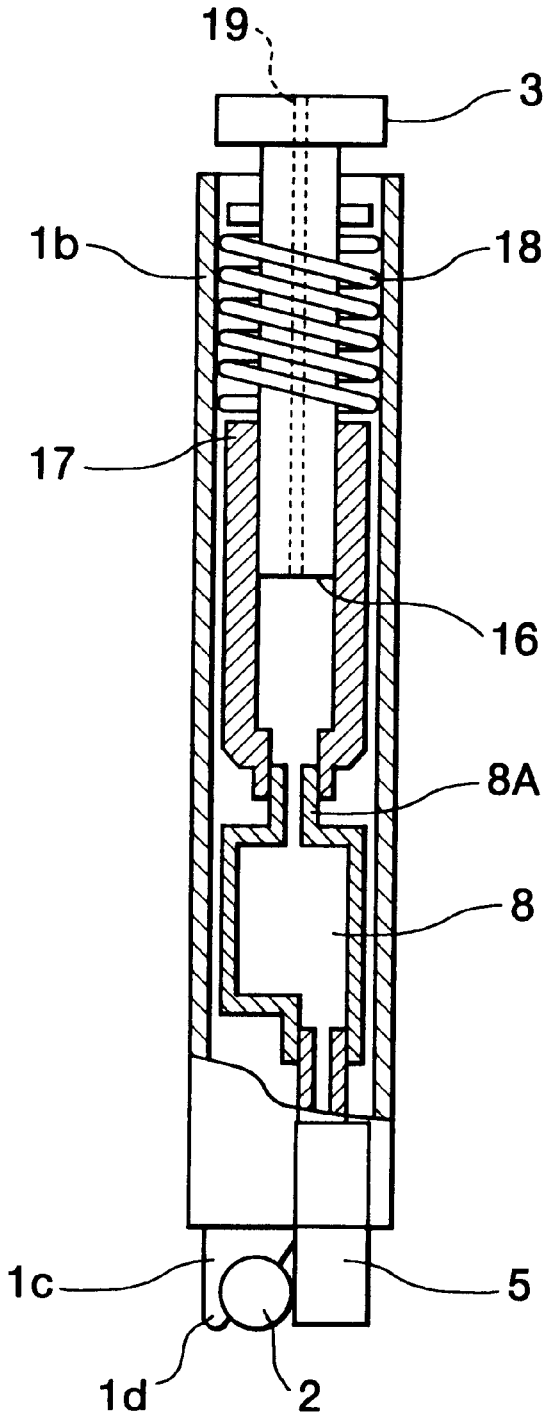
FIG. 3 is a cross-sectional view showing internal configuration of a portion of the manual printing device relating to a recovery unit of the manual printing device.

FIG. 3 is a different cross-sectional view from FIG. 2 showing the internal configuration of the manual printing device 1, particularly a recovery device incorporated in the manual printing device 1. A purge piston 16 and a purge cylinder 17 for applying pressure to ink in the ink tank 8 are disposed above the ink tank 8. The inside of the ink tank 8 and the inside of the purge cylinder 17 are in fluid connection via a connection line 8A. A purge button 3 is provided to the top of the purge piston 16 so as to protrude upward exposed to the outside of the body 16. A spring 18 for urging the purge button 3 upward is provided between the upper portion of the purge piston 16 and the purge cylinder 17. The spring pushes the purge button 3 back up after the purge button 3 is pressed downward. An air hole 19 for maintaining air pressure in the ink tank 8 at a fixed level is formed through the purge button 3 and the purge piston 16 and provides fluid connection between the ink tank 8 and atmosphere. It should be noted that the ink tank 8 is exchangeable and is detachably mounted between the ink jet recording head 5 and the purge piston 16.

Figure 4:
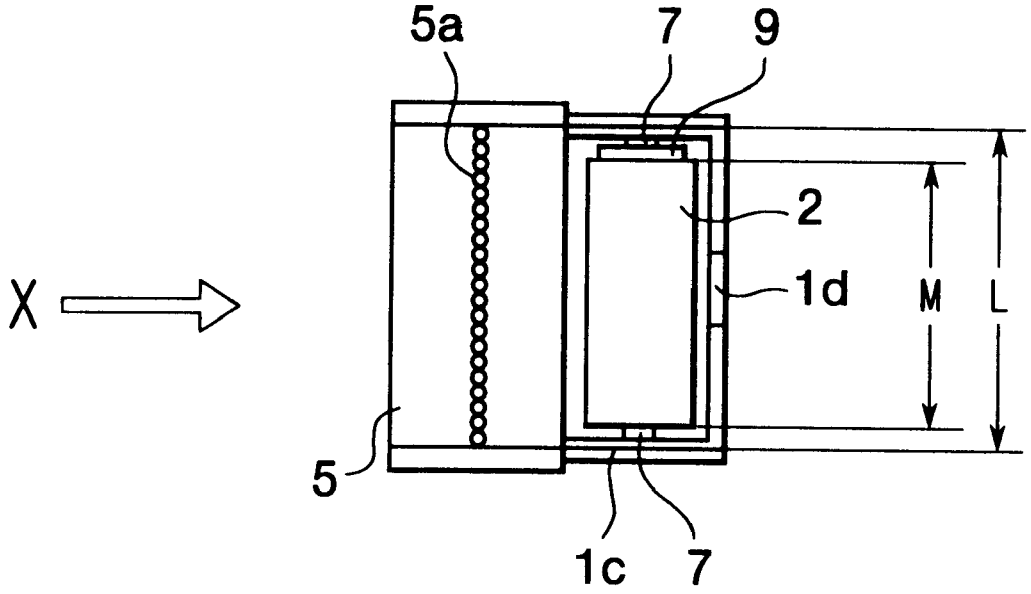
FIG. 4 is an underside view showing an ink jet recording head and a roller of a body portion of the manual printing device.

FIG. 4 is a view showing the underside of the ink jet recording head 5 and the roller 2 of the manual printing device 1. Next, an explanation will be provided for the positional relation between the ink jet recording head 5 and the roller 2 while referring to FIG. 4. A plurality of nozzles 5*a* are aligned on the surface of the ink jet recording head 5 to a widest width L, which determines the widest recording width of the print region, extending in a direction perpendicular to the scanning direction X. As described above, the roller 2 is rotatably supported by the shaft 7 and the pulley 9 at both sides. A portion M where the roller 2 contacts the recording medium P is set to a width narrower than and within the width L. The protrusion portion id is likewise formed to a width narrower than and within the width L.

Figure 5:
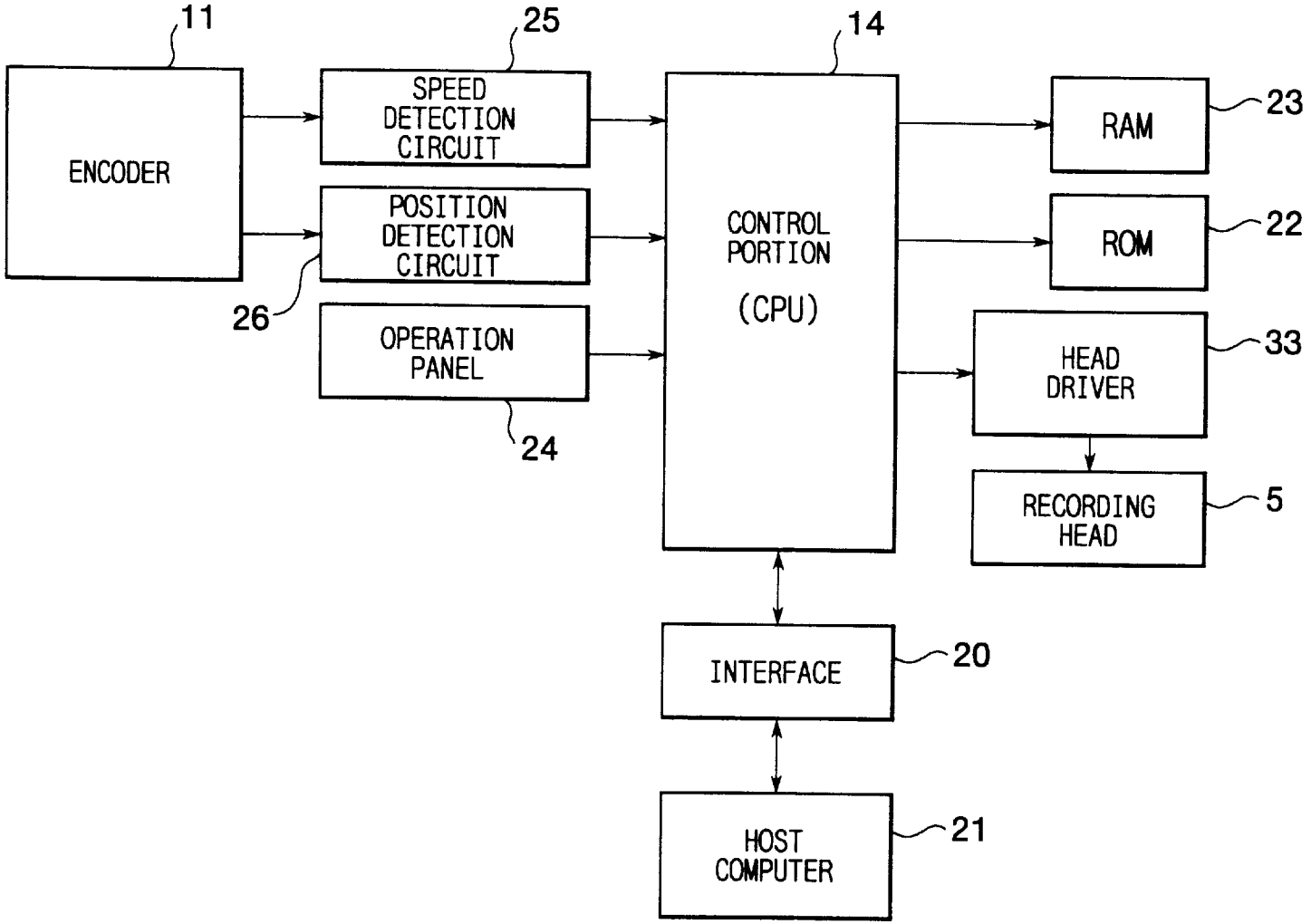
FIG. 5 is a block diagram showing a control system of the manual printing device.

FIG. 5 is a block diagram showing a control system of the manual printing device 1. The control portion (CPU) 14 performs overall control of the manual printing device 1 and is connected to a host computer 21 via the interface portion 20. The control portion 14 is also connected to a variety of other components including a ROM 22 storing a control program for controlling each function block according to a predetermined program; a RAM 23 for storing print data inputted from the host computer 21 via the interface 20; a head driver 33 for driving the ink jet recording head 5; and an operation panel 24 including the switch 4 and the like. Pulses from the encoder 11 for detecting rotational speed and rotational direction of the roller 2 are inputted to a speed detection circuit 25 and a position detection circuit 26, which are connected to the CPU 14. Speed of the manual printing device 1 and relative position between the manual printing device 1 and the recording medium P are detected by the speed detection circuit 25 and the position detection circuit 26, and then a detection signal is inputted to the control portion 14 accordingly. These electrical components are incorporated into the body 1*b* of the manual printing device 1.

Next, an explanation will be provided for printing operations of the manual printing device 1 with the above-described configuration. The manual printing device 1 is operated according to a predetermined program stored in the ROM 20. Input of print data is performed by the control portion 14 when the switch 4 is set to an input mode. The print data is inputted from the host computer 21 via the interface 20 by using an infrared signal. The inputted print data is first temporally stored in the RAM 23. When a user manipulates the switch 4 to transmit a print start signal to the control portion 14, the control portion 14 receives the signal, confirms that the print data is stored in the RAM 23, and then goes into a print standby condition.

At this point, the control portion 14 determines whether or not the rotation disk 12 of the encoder 11 is rotating. When it determines that the rotation disk 12 is rotating, the control portion 14 controls drive of the ink jet recording head 5 to print on the surface of the recording medium P by controlling output of the print data in association with rotational amount of the roller 2. In this way, the control portion 14 controls output of the print data to match the rotational amount of the roller 2 so that printing can be constantly performed on the recording medium P as predetermined regardless of whether the scanning speed of the body 1*b* across the surface of the recording medium P is uniform or not.

Next, an explanation will be provided for operation of the recovery device of the manual printing device 1 having the above-described configuration. A user performs a recovery operation of the ink jet recording head 5 before using the manual printing device 1, when he or she notices poor performance of the print head, or otherwise when necessary. In order to perform the recovery operation, the user pushes the purge button 3 down while covering the air hole 19 with his or her finger. By this operation, pressure is applied to ink in the ink tank 8 and consequently ink is ejected from the nozzles of the ink jet recording head 5. At this time, dust and air in the nozzles are also pushed out with the ink. Afterward, the user releases his finger from the purge button 3 so that the purge button 3 is pushed back up by the spring 18. Therefore, the user can repeatedly perform the operation if necessary. Further, when ink in the ink tank 8 is consumed during printing, air will enter the ink tank 8 through the air hole 19 so that air pressure in the ink tank 8 is maintained at a fixed level. Therefore, a negative pressure will not build up in the ink tank 8 when the level of ink decreases so that printing can be always performed properly.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A manual printing device for printing on a recording medium when scanned over the recording medium in a print direction, the manual printing device comprising:

an ink tank filled with ink;

a recording unit formed with an ink ejection aperture in fluid connection with the ink tank, the recording unit ejecting ink supplied from the ink tank through the ink ejection aperture onto the recording medium;

a housing that houses the ink tank; and a recovery unit for applying pressure to the ink in the ink tank to eject ink from the ink ejection aperture, wherein said ink tank and said recovery unit are all in a coaxial relationship within said housing, the recovery unit including:

a piston mechanism housed in the housing in a coaxial relationship with the housing, the piston mechanism having a piston for applying pressure to the ink in the ink tank when pressed in a pressing direction; and a pressing mechanism connected with the piston of the piston mechanism, the pressing mechanism moving coaxially with respect to the housing when moved in the pressing direction to press against the piston, said ink being ejected through said ink ejection aperture in a same direction as said pressing direction.

2. A manual printing device as claimed in claim 1, wherein the pressing mechanism is formed with a through hole for bringing the ink tank into fluid communication with atmosphere, thereby maintaining air pressure in the ink tank at atmospheric pressure.

3. A manual printing device as claimed in claim 2, the pressing mechanism including an upper portion exposed exterior to the housing.

4. A manual printing device as claimed in claim 3, wherein the through hole passes from the upper portion of the pressing mechanism to the ink tank.

5. A manual printing device as claimed in claim 1, the pressing mechanism including an upper portion exposed exterior to the housing.

6. A manual printing device as claimed in claim 1, wherein the recovery unit further includes an urging means for urging the pressing mechanism in a release direction opposite the pressing direction.

7. A manual printing device as claimed in claim 1, further comprising an elongated body, the ink tank and the recovery unit being disposed within the body and the recording unit being disposed at a lower end of the body.

8. A manual printing device as claimed in claim 7, further comprising a roller for easing scanning of the manual printing device across the recording medium and disposed at the lower end of the body upstream from the recording unit with respect to the print direction.

9. A manual printing device as claimed in claim 8, wherein:

the recording unit is further formed with a plurality of ink ejection apertures aligned in a first width in an alignment direction perpendicular to the print direction; and the roller extends within the first width in the alignment direction.

10. A manual printing device as claimed in claim 8, further comprising a protrusion portion disposed at the lower end of the body and for maintaining, in cooperation with the roller, the recording unit and the recording medium separated by a predetermined distance and the body in a predetermined posture.

11. A manual printing device as claimed in claim 8, further comprising an encoder disk housed in the body and connected to rotate in association with the roller to detect scanning amount of the manual printing device in the print direction.

12. A manual printing device as claimed in claim 1, wherein the ink tank is detachably provided in the manual printing device.

13. A manual printing device as claimed in claim 1, further comprising an elongated body, the ink tank and the recovery unit being disposed within the body and the recording unit being disposed at a lower end of the body.

14. A manual printing device as claimed in claim 13, further comprising a roller for easing scanning of the manual printing device across the recording medium and disposed at the lower end of the body upstream from the recording unit with respect to the print direction.

15. A manual printing device as claimed in claim 14, wherein:

the recording unit is further formed with a plurality of ink ejection apertures aligned in a first width in an alignment direction perpendicular to the print direction; and the roller extends within the first width in the alignment direction.

16. A manual printing device as claimed in claim 14, further comprising a protrusion portion disposed at the lower end of the body and for maintaining, in cooperation with the roller, the recording unit and the recording medium separated by a predetermined distance and the body in a predetermined posture.

17. A manual printing device as claimed in claim 14, further comprising an encoder disk housed in the body and connected to rotate in association with the roller to detect scanning amount of the manual printing device in the print direction.

18. A manual printing device as claimed in claim 1, wherein said housing has a tubular shape that is adapted for being held by hand.

19. A manual printing device for printing on a recording medium when scanned over the recording medium in a print direction, the manual printing device comprising:

a ink tank filled with ink;

a recording unit formed with an ink ejection aperture in fluid connection with the ink tank, the recording unit ejecting ink supplied from the ink tank through the ink ejection aperture onto the recording medium;

a tubular housing that is adapted for being held by hand and that houses the ink tank; and a recovery unit for applying pressure to the ink in the ink tank to eject ink from the ink ejection aperture, wherein said ink tank and said recovery unit are all in a coaxial relationship within said housing, the recovery unit including:

a piston mechanism housed in the housing in a coaxial relationship with the housing, the piston mechanism having a piston for applying pressure to the ink in the ink tank when pressed in a pressing direction; and a pressing mechanism connected with the piston of the piston mechanism, the pressing mechanism moving coaxially with respect to the housing when moved in the pressing direction to press against the piston, said ink being ejected through said ink ejection aperture in a same direction as said pressing direction.

20. A pen-shaped printing device for printing on a recording medium when scanned over the recording medium in a print direction, the pen-shaped printing device comprising:

a tubular housing that is adapted for being held by hand;

an ink tank housed in the housing and filled with ink;

a recording unit formed with an ink ejection aperture in fluid communication with the ink tank to receive ink from the ink tank, the recording unit ejecting ink received from the ink tank through the ink ejection aperture onto the recording medium;

a recovery unit for applying pressure to the ink in the ink tank to forcibly eject ink from the ink ejection aperture, wherein said ink tank and said recovery unit are all in a coaxial relationship within said housing, the recovery unit including:

a purge cylinder housed in the housing in a coaxial relationship with the housing, the purge cylinder being in fluid connection with the ink tank; and a purge piston with one end disposed coaxially in the cylinder and the other end protruding from a tip of the housing, so that when the other end is pressed in a pressing direction toward the ink tank, the purge piston moves coaxially with respect to the housing and applies pressure to the ink in the ink tank, said ink being ejected through said ink ejection aperture in a same direction as said pressing direction.

* * * * *